US008130188B2

(12) United States Patent
Shin

(10) Patent No.: US 8,130,188 B2
(45) Date of Patent: Mar. 6, 2012

(54) METHOD FOR REALIZING GRAY LEVELS OF LCD DEVICE

(76) Inventor: Yong Seob Shin, Kyoungki-do (KR)

( * ) Notice: Subject to any disclaimer, the term of this patent is extended or adjusted under 35 U.S.C. 154(b) by 1263 days.

(21) Appl. No.: 11/146,398

(22) Filed: Jun. 6, 2005

(65) Prior Publication Data

US 2006/0103616 A1 May 18, 2006

(30) Foreign Application Priority Data

Nov. 12, 2004 (KR) ..... 10-2004-0092702

(51) Int. Cl.
*G09G 3/36* (2006.01)

(52) U.S. Cl. ..... 345/89; 345/102

(58) Field of Classification Search ..... 345/89, 345/102

See application file for complete search history.

(56) References Cited

U.S. PATENT DOCUMENTS

| | | | | |
|---|---|---|---|---|
| 6,046,716 | A * | 4/2000 | McKnight | 345/95 |
| 6,317,112 | B1 * | 11/2001 | Handschy et al. | 345/89 |

FOREIGN PATENT DOCUMENTS

| | | |
|---|---|---|
| JP | 2001-343941 | 12/2001 |
| JP | 2003-177723 | 6/2003 |
| JP | 2004-073500 | 3/2004 |
| JP | 2004-233522 | 8/2004 |
| JP | 2004-309847 | 11/2004 |
| JP | 2005-301220 | 10/2005 |
| TW | 391128 | 5/2000 |

* cited by examiner

*Primary Examiner* — Yong H Sim

(57) ABSTRACT

Disclosed is a method for realizing gray levels of a liquid crystal display (LCD) device, which realize various gray levels by interworking a gamma voltage and a sub-frame. The method includes the steps of dividing a liquid crystal response time interval for a pixel during one frame into n sequential sub-frames, enabling the pixel and applying a gamma voltage having a fixed level to the pixel, filling electric charges in the pixel by using the gamma voltage during each of the n specific sub-frames, and disabling the pixel at an end time point of a predetermined $i^{th}$ sub-frame, the i being an integer, wherein an amount of light projected on the pixel is adjusted by regulating a time point at which the pixel is disabled during each of the n specific sub-frames.

7 Claims, 4 Drawing Sheets

METHOD FOR REALIZING GRAY LEVELS OF LCD DEVICE

BACKGROUND OF THE INVENTION

1. Field of the Invention

The present invention relates to a method for realizing gray levels of a liquid crystal display (LCD) device, and more particular to a method for realizing gray levels of an LCD device, which realizes the gray levels by interworking a gamma voltage and a sub-frame.

2. Description of the Prior Art

As generally known in the art, a liquid crystal display (LCD) device has a liquid crystal layer formed between an upper substrate including a color filter and a lower substrate spaced from the upper substrate with a predetermined distance. A background light source is under the lower substrate. In this LCD device, a voltage having a predetermined intensity is applied to the liquid crystal in order to adjust a liquid crystal layer transmission rate of the background light source according to the degree of twist of the liquid crystal, so that a user can obtain a desired image signal. Herein, in order to obtain the image signal, a data voltage including image information in the form of a gray level is applied to the liquid crystal. According to realization types, the LCD device is classified into an LCD device employing a color filter scheme in which R, G, and B color filters are formed on the upper substrate and white light is transmitted through the substrate, so that the image signal is obtained and an LCD device employing a Field Sequential Color (FSC) scheme in which each of R, G, and B light is transmitted through a substrate, so that the image signal is obtained.

A method for realizing gray levels in a LCD device includes a scheme in which a reference gamma voltage is set in a control board and a gamma curve is adjusted using a resistor string in a source driver and a digital operation scheme enabling the realization of the gray levels through an on/off operation at a plurality of sub-frames.

In the scheme of adjusting the gamma curve using the resistor string in the source driver, N reference voltages set in an external buffer are employed as the reference gamma voltages in the source driver. The source driver sets a voltage of each detailed gray level using an R-string circuit, thereby realizing gray levels by means of a D/A converter and an internal buffer. In the digital operation scheme, one frame is divided into plural sub-frames, and digital data is input to each sub-frame and the sub-frames are on/off driven, thereby realizing a gray level.

However, in the scheme of adjusting the gamma curve using the resistor string in the source driver, it is necessary to install a D/A converter and a buffer in a driver IC (source driver) in order to realize each gray level, so that the size of the driver IC may increase. Also, in the digital operation scheme, since liquid crystal is charged/discharged correspondingly to the number of the sub-frames, a high-speed driver IC is required and power consumption increases according to the high speed operation of the driver IC.

SUMMARY OF THE INVENTION

Accordingly, the present invention has been made to solve the above-mentioned problems occurring in the prior art, and an object of the present invention is to provide a method for realizing gray levels of an LCD device, which can reduce the size of a driver and solve a problem occurring in a high-speed operation by interworking a transmissivity characteristic according to gray level voltages and an on/off operation at a sub-frame.

To accomplish the above object, there is provided a method for realizing gray levels of a liquid crystal display unit, the method including the steps of dividing a liquid crystal response time interval for a pixel during one frame into n sequential sub-frames, enabling the pixel and applying a gamma voltage to the pixel during a fixed specific sub-frame, filling electric charges in the pixel by using the gamma voltage during the specific sub-frame, and disabling the pixel at an end time point of the specific sub-frame, wherein an amount of the charges filled in the pixel is adjusted by controlling a level of the gamma voltage.

According to the present invention, each of the n sub-frames has a fixed data addressing time interval and a blank time interval, and the amount of light passing through the pixel is adjusted by controlling a level of the blank time interval.

According to the present invention, the blank time interval is adjustable by regulating a number of a main clock of the liquid crystal display unit.

According to another aspect of the present invention, there is provided a method for realizing gray levels of a liquid crystal display unit, the method including the steps of: dividing a liquid crystal response time interval for a pixel during one frame into n sequential sub-frames, enabling the pixel and applying a gamma voltage having a fixed level to the pixel, filling electric charges in the pixel by using the gamma voltage during each of the n specific sub-frames, and disabling the pixel at an end time point of a predetermined $i^{th}$ sub-frame, the i being an integer, wherein an amount of light projected on the pixel is adjusted by regulating a time point at which the pixel is disabled during each of the n specific sub-frames.

According to another aspect of the present invention, each of the n sub-frames has a fixed data addressing time interval and a blank time interval, and the amount of light passing through the pixel is adjusted by controlling a level of the blank time interval.

According to another aspect of the present invention, the blank time interval is adjustable by regulating a number of a main clock of the liquid crystal display unit.

According to still another aspect of the present invention, there is provided a method for realizing gray levels of a liquid crystal display unit, the method including the steps of dividing a liquid crystal response time interval for a pixel during one frame into n sequential sub-frames, enabling the pixel and applying a gamma voltage to the pixel during one frame, filling electric charges in the pixel by using the gamma voltage during each of the n specific sub-frames, and disabling the pixel at an end time point of a predetermined $i^{th}$ sub-frame, the i being an integer, wherein an amount of light passing through the pixel is adjusted by controlling a level of the gamma voltage while regulating a time point at which the pixel is disabled during each of the n specific sub-frames.

According to still another aspect of the present invention, wherein each of the n sub-frames has a fixed data addressing time interval and a blank time interval, and the amount of light passing through the pixel is adjusted by controlling a level of the blank time interval.

According to still another aspect of the present invention, the blank time interval is adjustable by regulating a number of a main clock of the liquid crystal display unit.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
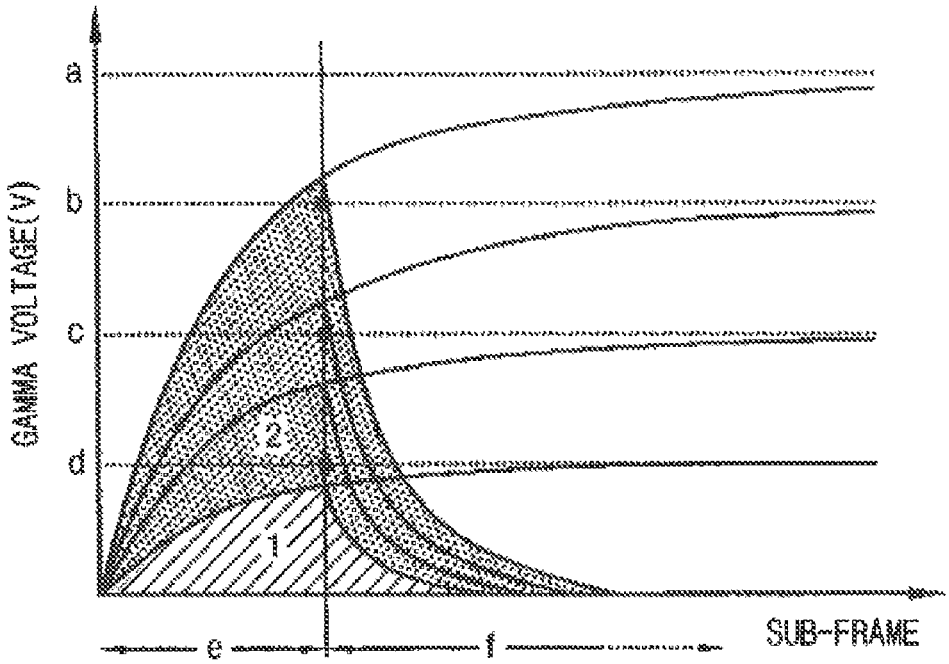
FIG. 1 is a graph for explaining a method for realizing gray levels according to the first embodiment of the present invention.

Hereinafter, preferred embodiments of the present invention will be described with reference to the accompanying drawings. In the following description and drawings, the same reference numerals are used to designate the same or similar components, and so repetition of the description on the same or similar components will be omitted.

FIG. 1 is a graph for explaining a method for realizing gray levels according to the first embodiment of the present invention.

According to the first embodiment of the present invention, one frame for data input to a specific pixel is divided into a plurality of sub-frames, gamma voltages having different levels a, b, c, and d are applied to the pixel during a fixed specific sub-frame (reference numeral e), and the pixel is disabled at the end time point of the specific sub-frame. At this time, different gamma voltages applied to the pixel change the reaction degree of liquid crystal reacting during a specific frame. In other words, although the pixel to which voltages having different levels are applied is disabled at the same time point, different reactions of liquid crystal may be obtained. In detail, when gray voltages having levels of "a" and "d" are applied to the pixel, the reactions of liquid crystal shown by reference numerals 1 and 2 are obtained. Accordingly, different gray levels may be realized through different gamma voltages applied to a pixel.

Figure 2:
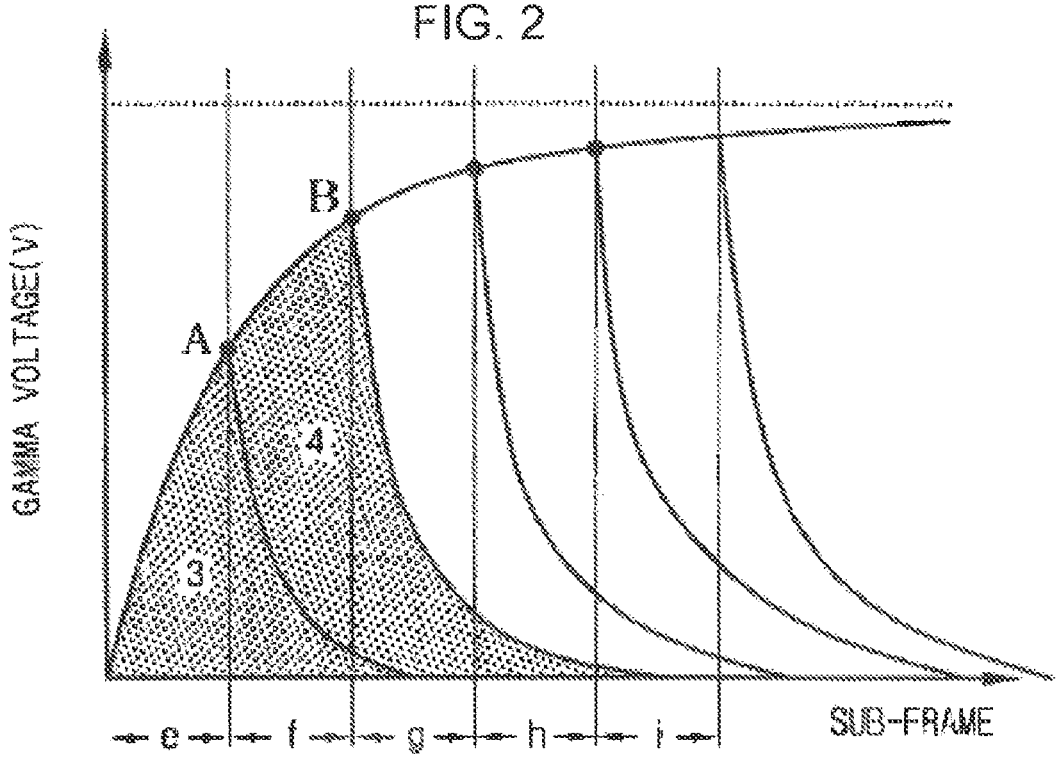
FIG. 2 is a graph for illustrating a method for realizing gray levels according to the second embodiment of the present invention.

FIG. 2 is a graph for illustrating a method for realizing gray levels according to the second embodiment of the present invention.

According to the second embodiment of the present invention, one frame for data input to a specific pixel is divided into a plurality of sub-frames e, f, g, h, and i according to time intervals, gamma voltages having the same levels are applied to a pixel during each sub-frame, and the pixel is disabled at a predetermined sub-frame. At this time, although the same gray level voltages are applied to the pixel, the reaction degree of the liquid crystal varies dependent on sub-frames at which the pixel is disabled. For example, when the pixel is disabled at the second sub-frame (reference numeral f) as shown by reference numeral 7 or at the third sub-frame (reference numeral g) as shown by reference numeral 4, the reaction degree of liquid crystal is shown by areas corresponding to reference numerals 3 and 4. Accordingly, gray levels may be realized by determining a sub-frame at which a pixel is disabled.

Figure 3:
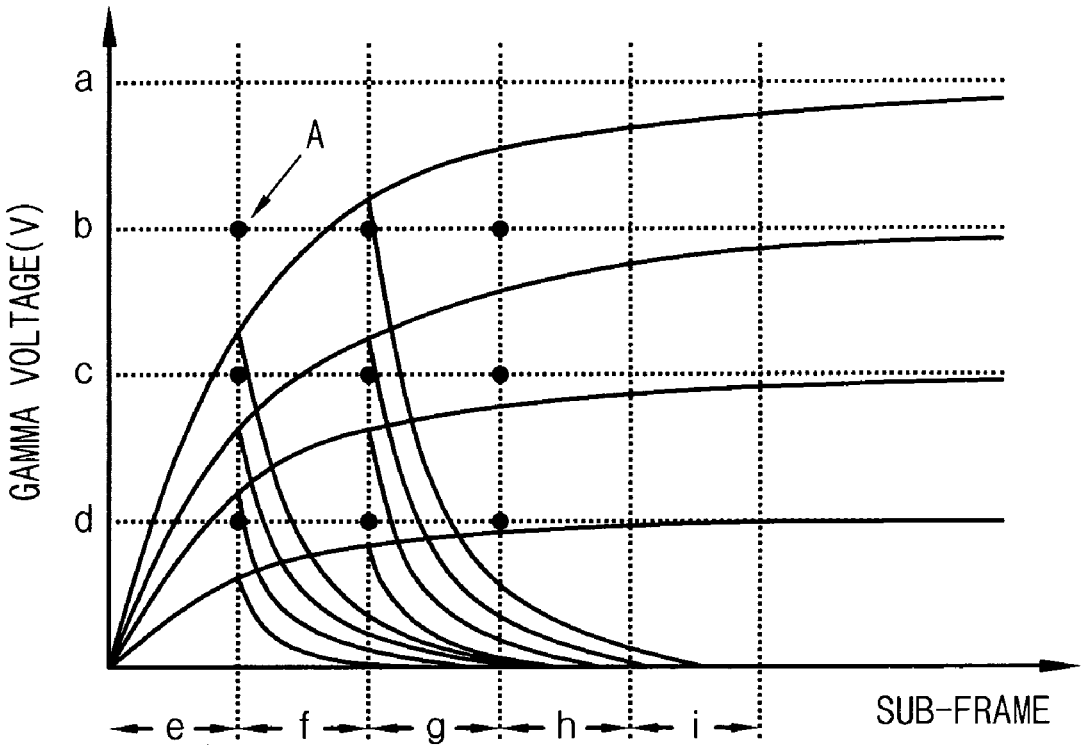
FIG. 3 is a graph for explaining a method for realizing gray levels according to the third embodiment of the present invention.

FIG. 3 is a graph for explaining a method for realizing gray levels according to the third embodiment of the present invention.

The third embodiment of the present invention relates to a method obtained by combining the methods of realizing gray levels described with reference to FIGS. 1 and 2. According to the third embodiment of the present invention, one frame is divided into a plurality of sub-frames (reference numerals e, f, g, h and i), gamma voltages (reference numerals a, b, c, and d) having mutually different levels are applied to a pixel during each of the sub-frames, and the pixel is disabled at a predetermined sub-frame. Herein, the reaction degree of liquid crystal varies depending on the gamma voltages applied to the pixel and types of the sub-frames at which the pixel is disabled. For example, a gamma voltage to be applied to the pixel at the first sub-frame (reference numeral e) is selected and the selected gamma voltage is applied to the pixel. Herein, gray level voltages for a pixel are planned in such a manner that a gray level voltage corresponding to input data is selected in a look-up table (LUT). When the pixel is disabled at the second sub-frame (reference numeral f), the reaction degree of liquid crystal for each gray level voltage varies depending on the selection of a gray level voltage at the first sub-frame (reference numeral e). When the pixel is disabled at the third sub-frame (reference numeral g), the reaction degree of liquid crystal varies according to the levels of the gray level voltage. Accordingly, if timing required for disabling the pixel is controlled at each of intersections (reference numeral A) between gray level voltages and sub-frames, more gray levels may be realized. In detail, if M (1, 2, 3, . . . , M) gamma voltages having different levels and N (1, 2, 3, . . . , N) sub-frames are used, (M−1)*(N+1) gray levels may be realized.

Figure 4:
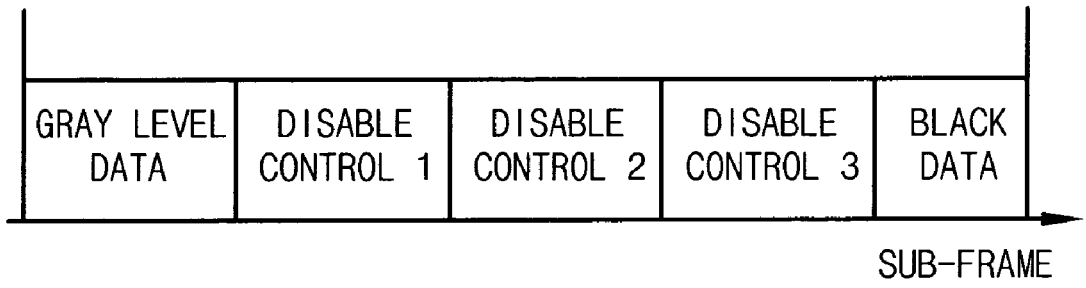
FIG. 4 is a view for explaining a method for disabling a pixel.

FIG. 4 is a view for explaining a method for disabling a pixel.

In the method for disabling each pixel at each frame, black data is used for each pixel to be disabled. In other words, a sub-frame used for disabling each corresponding pixel is determined in a look-up table and a voltage higher than that of the black data is applied to the last sub-frame for data (in a case of a TN mode), thereby reducing reaction time of liquid crystal and allowing the liquid crystal to completely react until the start time point of a next frame. This makes liquid crystal in a reference state, thereby solving the problem of showing different brightness according to start time points of frames even when each pixel is disabled at the same time point and each gamma voltage has the same level.

FIGS. 5 to 8 are graphs for explaining a method for finely realizing gray levels according to the control of frame time.

Figure 5:
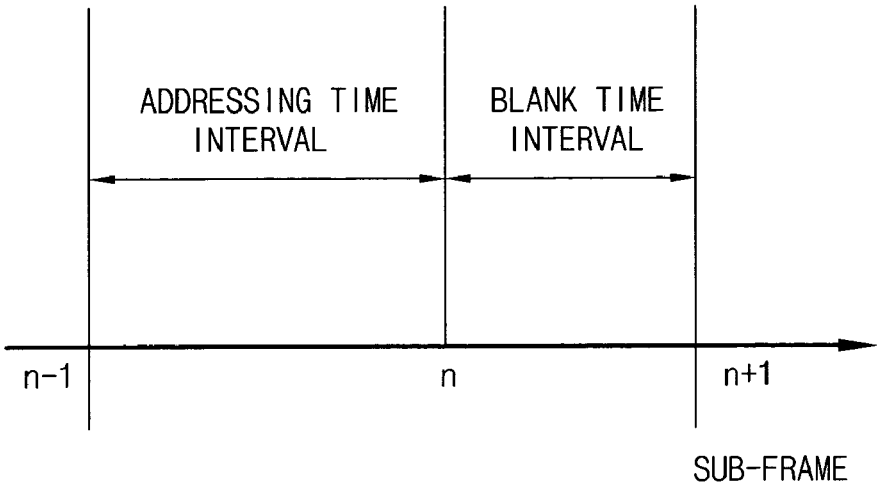
FIGS. 5 to 8 are graphs for explaining a method for finely realizing gray levels according to the control of frame time.

Referring to FIG. 5, each sub-frame has a data addressing time interval and a blank time interval for the sub-frame duration. Herein, it is possible to finely realize gray levels by fixing the data addressing time interval and adjusting the blank time interval.

Figure 6:
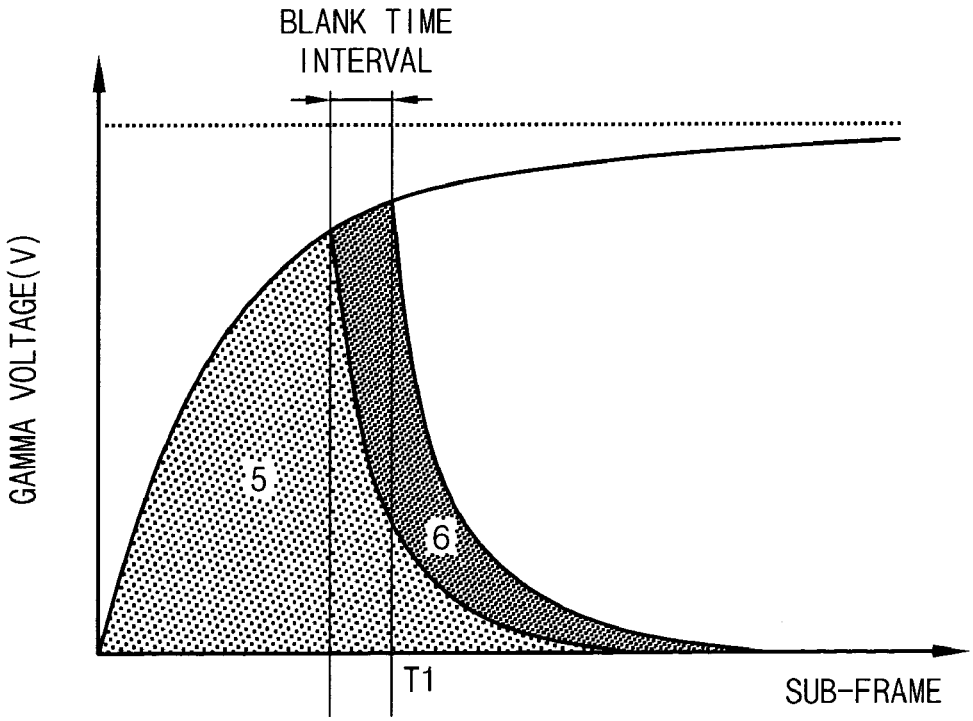

Referring to FIG. 6, in the method for finely realizing gray levels according to the control of frame time, a gamma voltage is applied to a pixel for the sub-frame duration, and the pixel is disabled at the end time point of the sub-frame. Herein, gray levels having the reaction degrees of liquid crystal corresponding to areas shown by reference numerals 5 and 6 may be realized by adjusting the blank time interval of each frame. Herein, the blank time interval is adjusted by regulating the number of a main clock, and the main clock is planned in such a manner that the number thereof is programmable in a timing controller.

Figure 7:
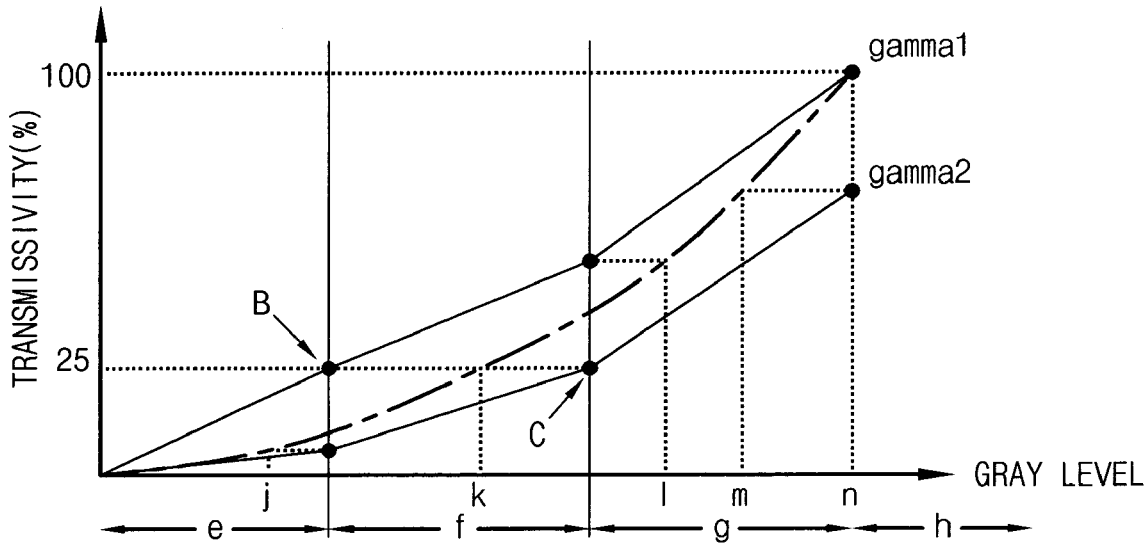

Referring to FIG. 7, a frame is divided into four sub-frames (reference numerals e, f, g, and h) and two gamma voltages having mutually different levels are applied to a pixel for each sub-frame duration, so that two gamma curves gamma 1 and gamma 2 are formed. Herein, a dotted curve represents a reference gamma curve. The two gamma curves have the same gray level (k) because the two gamma curves have the same transmissivity at intersections B and C between a sub-frame and the two gamma curves showing the transmissivity of liquid crystal. Accordingly, the number of gray levels (which may be realized) is reduced by one and becomes six.

Figure 8:
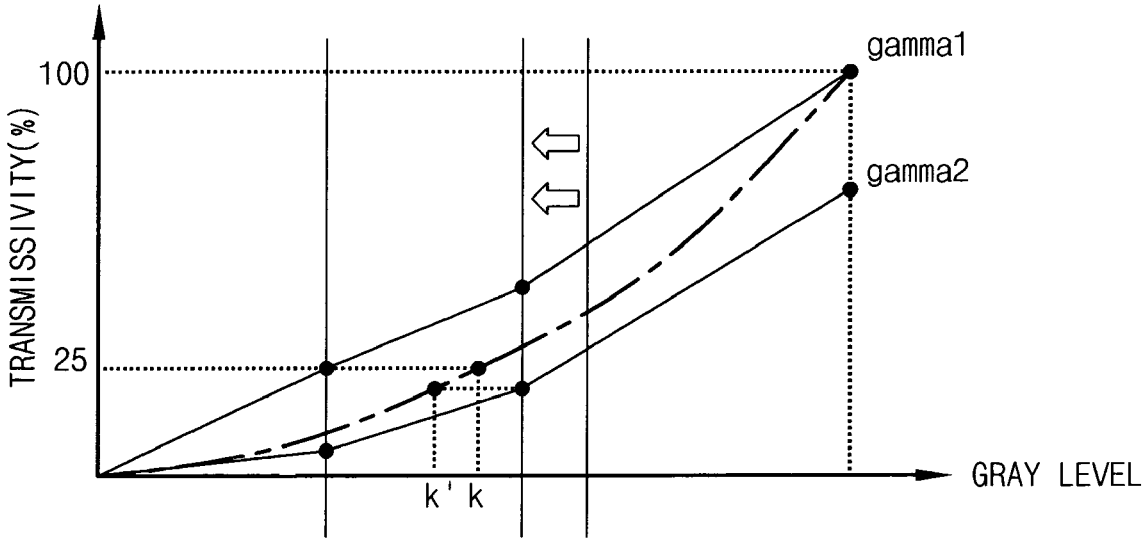

Referring to FIG. 8, in order to reduce the number of gray levels to be realized as described above and finely control the gray levels, frame time is controlled by adjusting a blank time interval of the third sub-frame (reference numeral g). Therefore, it is possible to realize a new gray level (reference numeral k') and realize gray levels in more detail by increasing the number of gray levels which can be realized.

In a method for realizing gray levels of a LCD device according to the present invention as described above, it is possible to realize (M−1)*(N+1) gray levels by interworking M gamma voltages and N sub-frames. A gray level at each intersection is matched with each gray level in a look-up table, and it is possible to more finely realize gray levels by adjusting a blank time interval of each frame or each sub-frame. Accordingly, in the present invention, a gamma gray level is given to the digital operation scheme enabling the realization of the gray level through an on/off operation at each sub-frame as operated through a field sequential color scheme, thereby solving problems according to a high speed operation of a driver IC and reducing the size of the driver IC.

As described above, according to the present invention, a gamma voltage is combined with a sub-frame in order to realize gray levels, thereby reducing power consumption according to the high-speed operation of a driver IC and the size of the driver IC in realization of the gray levels.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method for realizing gray levels of a liquid crystal display unit, the method comprising the steps of:

dividing a liquid crystal response time interval for a pixel during one frame into N sequential sub-frames, where N is an integer, having a value that is greater than or equal to three, each of the N, sequential sub-frames being of substantially equal time duration;

enabling the pixel and applying a gamma voltage to the pixel during one frame;

filling electric charges in the pixel by using the gamma voltage during each of the N specific sub-frames; and disabling the pixel at an end time point of a predetermined $i^{th}$ sub-frame, $i^{th}+1$ to N subframes being disabled, the i being an integer, and the end point time of disabling the pixel being independently controllable in each frame by selecting independently, the end point time of the $i^{th}$ sub-frame of each frame;

wherein an amount of light passing through the pixel is adjusted by controlling a level of the gamma voltage while regulating a time point at which the pixel is disabled at an end time point of a predetermined $i^{th}$ sub-frame.

2. The method as claimed in claim 1, wherein each of the N sub-frames has a fixed data addressing time interval and a blank time interval, and the amount of light passing through the pixel is adjusted by controlling the duration of the blank time interval.

3. The method as claimed in claim 1, wherein each of the N sub-frames has a fixed data addressing time interval and a changeable blank time interval, and the amount of light passing through the pixel is adjusted by controlling the duration of the blank time interval.

4. The method of claim 1, wherein the amount of light passing through the pixel is determined by controlling the timing of the disabling of a pixel.

5. The method of claim 1, wherein the amount of light passing through the pixel is determined exclusively by controlling the timing of the disabling of a pixel.

6. The method of claim 1, wherein the step of applying a gamma voltage includes the step of applying a gamma voltage selected from M different gamma voltage levels and wherein the amount of light passing through the pixel is adjusted by selecting said gamma voltage level and a time point at which the pixel is disabled, whereby the amount of light passing through the pixel is thereby selectable to be one of at least (M−1)*(N+1) different levels.

7. The method as claimed in claim 2, wherein the blank time interval is adjustable by regulating a number of a main clock of the liquid crystal display unit.

* * * * *